United States Patent [19]

Snyders

[11] Patent Number: 4,579,378

[45] Date of Patent: Apr. 1, 1986

[54] MORTAR JOINT POINTING GUIDE

[76] Inventor: Robert V. Snyders, 31 W. Brentmoor, County of St. Louis, Mo. 63105

[21] Appl. No.: 666,924

[22] Filed: Oct. 31, 1984

[51] Int. Cl.[4] ..... E04G 21/20
[52] U.S. Cl. ..... 294/3.5; 15/257 R
[58] Field of Search ..... 15/257 R, 257.1, 235.3, 15/235.4, 235.5; 118/504; 294/3.5

[56] References Cited

U.S. PATENT DOCUMENTS

| | | | |
|---|---|---|---|
| 1,851,497 | 3/1932 | Darling | 15/257 R |
| 2,167,699 | 8/1939 | Weesner | 15/257 R |
| 3,790,201 | 2/1974 | Morsilli | 294/3.5 |

FOREIGN PATENT DOCUMENTS

| | | | |
|---|---|---|---|
| 916854 | 8/1954 | Fed. Rep. of Germany | 294/3.5 |
| 2035432 | 6/1980 | United Kingdom | 15/235.3 |

*Primary Examiner*—Edward L. Roberts
*Attorney, Agent, or Firm*—Gravely, Lieder & Woodruff

[57] ABSTRACT

A mortar joint pointing guide having a mortar supporting plate formed with a front opening defined by an elongated horizontal margin and end flanges presenting margins at right angles to the horizontal margin so that a clear opening frames a horizontal and two vertical joints of a brick for guiding the application of the pointing mortar. The guide has a centrally located handle and a front margin extension for cooperation with the handle to steady the guide in use, and in addition the sides and rear margins of the guide are formed with low flanges to retain mortar on the plate.

3 Claims, 3 Drawing Figures

MORTAR JOINT POINTING GUIDE

BACKGROUND OF THE INVENTION

1. Field of the Invention

This invention pertains to a pointing guide for repairing, replacing or adding mortar to the joints in a building wall composed of brick or blocks joined together by mortar in which the joints between blocks is defined by a visible mortar line.

2. Description of the Prior Art

The problem in existence at the present time, and for many prior years, is that the pointer mason must place a quantity of mortar on the pointing tool and apply it free-hand in a joint in a block wall, such as a wall composed of bricks which is a common type of building. The free-hand application of mortar to point a wall of bricks or blocks allows some of the mortar to attach itself to a surface where it is not wanted. The mortar thus attached where it is not wanted requires a clean-up operation along with extra expense.

Some attempts have been made to improve on the pointing of masonry joints, such as the brick mason's pointing tool in U.S. Pat. No. 1,851,497 of Mar. 29, 1932 wherein right angularly related plates form the tool. The horizontal plate carries the mortar and the vertical plate has slots which can be aligned with the joints to be pointed. The vertical plate is said to prevent smearing the mortar on the face of the bricks. Another example of the prior art is seen in U.S. Pat. No. 2,167,699 of Aug. 1, 1939. In this patent two different types of tools are needed because one tool has a horizontal slot and the other tool has a vertical slot. The mortar is placed in a rounded trough, and the slots are formed in a vertical back member on the trough.

The problem believed to be inherent with such prior art examples is that the tool is difficult to hold and the vertical or back plate on each obscures the placement of the tool. It is apparent that the mortar has to be lifted to the slot in the back plate and pushed through a slot. The latter operation requires a great deal of skill in order to hold the back plates in proper position throughout the pointing operation.

BRIEF DESCRIPTION OF THE INVENTION

The mortar joint pointing guide of the present invention embodies a structure that overcomes the problems of the prior art, does not require a great deal of skill, and can be used by amateurs to accomplish a superior pointing result with little or no clean-up required.

A preferred embodiment of the pointing guide comprises a plate formed with a front horizontal margin of a length to match a standard brick, a pair of upwardly directed wing-type flanges, one at each end of the front margin to place a vertical margin at about right angles to the front margin, a flat usable surface on which pointing mortar can be placed, a handle below the usable surface to support the guide as well as the pointing mortar, and an element on the front margin to rest on a brick or block below the joint being pointed.

The preferred embodiment has as an important object the attainment of great stability of the guide during pointing mortar joints, the provision of a clear open view of the horizontal and vertical joints to be pointed, and the exposure of three joints of a brick at a time. Other features will be set forth in the following specification.

DETAILED DESCRIPTION OF THE EMBODIMENT

Figure 1:
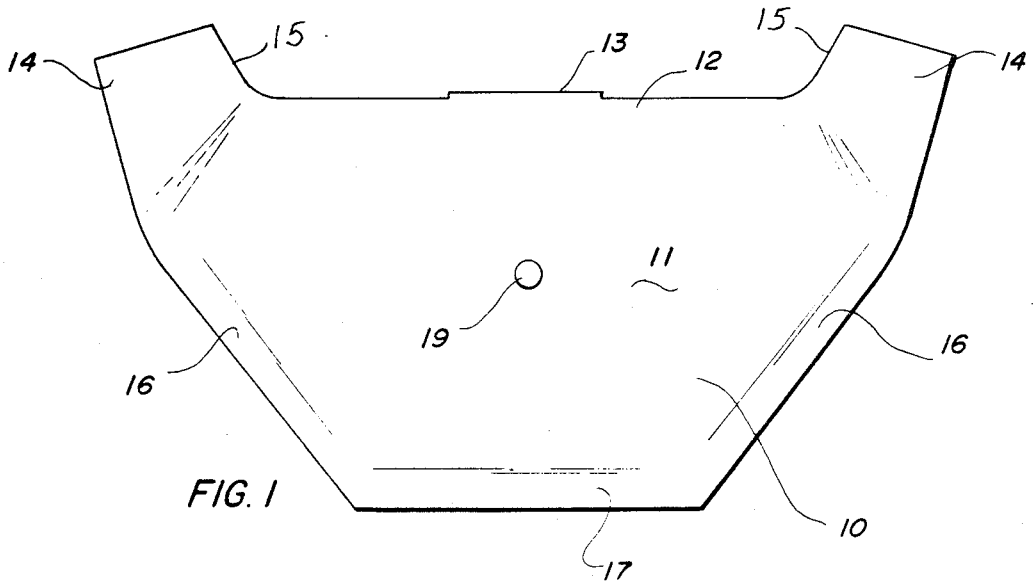
FIG. 1 is a top plan view of the pointing guide.

The pointing guide is in the form of a plate 10 having a top usable surface 11 for the support of a quantity of mortar to be applied to the joints in a brick or block wall. The surface 11 is bounded by a front margin 12 on which a projecting lip element 13 is formed generally centrally of the length of that front margin. The plate is formed at each end of the front margin 12 with upwardly extending flanges 14 which present margins 15 directed at about a right angle to the front margin 12. The margins 15 have a length which extends along the vertical joints in a brick wall, and the front margin 12 has a length between the vertical margins 15 about equal to the length of a horizontal joint under a brick.

When used to point a wall composed of generally standard bricks, the opening between the spaced apart flanges 15 will be about 9 inches along the front flange 12, and the lip element 13 on the front margin 12 has a length which is preferably about 2 inches to provide lateral stability when in use.

Figure 2:
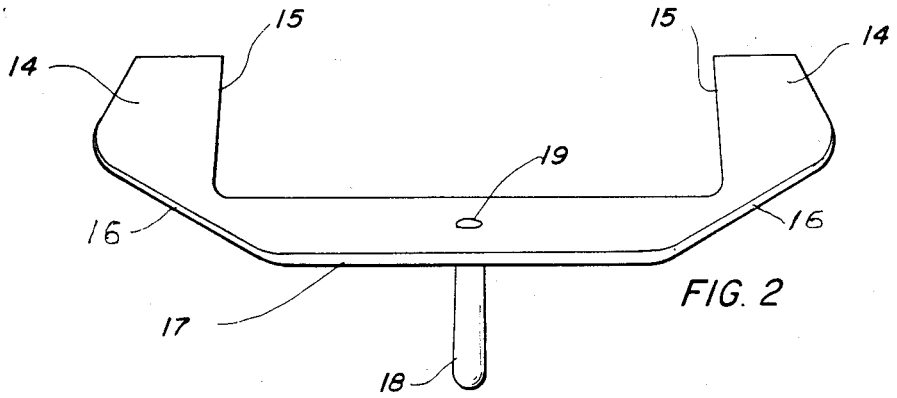
FIG. 2 is a perspective view of the pointing guide as seen from the rear.

The views of FIGS. 1 and 2 show that the flat usable surface 11 is further bounded by low marginal flanges 16 along the sides extending from the upwardly extending flanges 14 to join with a rear low flange 17 opposite the front margin 12. These low flanges 16 and 17 form the flat surface 11 into a shallow dish for retaining mortar that may be more fluid than usual, thereby allowing the guide to be slightly tilted so the mortar will not migrate toward the front margin 12 while the usual tucking tool (see FIG. 3) is manipulated to move a suitable quantity of the mortar into either a horizontal joint or the adjacent vertical joints.

Figure 3:
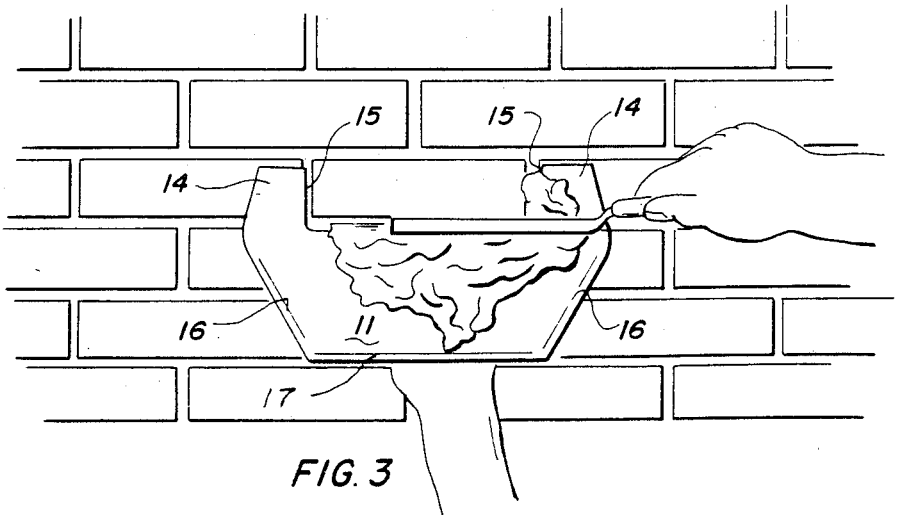
FIG. 3 is a vertical view of the pointing guide aligned with a brick in a brick wall to expose the joints on the vertical ends and on the horizontal.

FIG. 3 illustrates the application of the pointing guide 10 to a brick wall for exposing the joints toward which the mortar is to be guided by the tucking tool. The guide 10 is easily held by its handle 18 (see FIG. 2) that is attached to the under side of the usable surface 11 by a suitable securing means 19. While the flanges 14 have inner margins 15 in alignment with at right angles to margin 12 (see FIG. 3), the surface of these flanges back of their margins is curved up from the flat surface 11 to aid in moving mortar into the vertical joints at each end of a brick. The arrangement of the handle and the low flanges allows the guide to be used with either hand on the handle.

While the present pointing guide has been arranged to make pointing easy and non-messy for amateurs and home handy-men, it is also equally useful to the more professional pointers to simplify the job of pointing mortar joints. Once the joints have been packed, a finishing and smoothing operation can take place without the guide 10.

The present embodiment has been given in applying the pointing guide 10 to a brick wall for purposes of showing its utility and novelty. It is, of course, possible to adapt the concept to other sizes of pointing guides to take care of stone and block walls requiring joint pointing.

I claim:

1. A mortar joint pointing guide for use in pointing the joints between building blocks originally united with horizontal and vertical mortar joints, the guide comprising:

(a) a plate having a flat usable surface bounded by upwardly curved margins interrupted by a first elongated margin in the same plane with said flat surface, said first elongated margin ending in raised wing-like flanges extending upwardly from and at an angle to said flat surface, said wing-like flanges merging with said curved margins and having margins located to be in alignment with said first margin to form with said first margin an opening substantially representing the horizontal and vertical mortar joints of at least one building block and with said elongated margin and said margins on said wing-like flanges being in a common plane in positions for framing the mortar joints; and (b) handle means attached to said guide in position for manipulating said elongated margin and said flange margins, with a quantity of mortar placed on said flat usable surface, into a position in which said first margin and said flange margins are adjacent the horizontal and vertical mortar joints to be pointed with the mortar placed on said flat surface and said curved margins retain the mortar on said flat surface.

2. The guide set forth in claim 1 wherein said plate is metallic and said first elongated margin on said flat usable surface is provided with a projecting lip forming an extension of and substantially centrally positioned on said elongated margin of said flat usable surface to engage a building block adjacent the block positioned in substantial alignment with said flanges and stabilize the guide.

3. A mortar joint pointing guide for use in pointing the mortar joints between building blocks originally united along horizontal and vertical joints, the guide comprising:

(a) a flat mortar supporting surface having a marginal lip extending along a front margin of said flat surface;

(b) flange means defining the ends of said front marginal lip, said flange means being shaped to provide other front margins in continuation of said first front margin, said flange means and other front margins extending above said flat surface for retaining mortar within an opening defined by said front margin and said other front margins;

(c) shaped edges on said flat mortar supporting surface extending around the perimeter of said supporting surface from one flange means to the other; and (d) handle means attached to said support surface for manipulating said surface into a position with said front and other front margins concurrently framing the horizontal and vertical joints of a building block to be pointed with mortar on said flat surface.

* * * * *

UNITED STATES PATENT AND TRADEMARK OFFICE

CERTIFICATE OF CORRECTION

PATENT NO. : 4,579,378

DATED : April 1, 1986

INVENTOR(S) : Robert V. Snyders

It is certified that error appears in the above-identified patent and that said Letters Patent are hereby corrected as shown below:

Column 2, line 51, "in alignment with" should read "in alignment with and".

Signed and Sealed this

*Twenty-second* Day of *July 1986*

[SEAL]

*Attest:*

DONALD J. QUIGG

*Attesting Officer*

*Commissioner of Patents and Trademarks*